US007621526B2

(12) United States Patent
Blaser et al.

(10) Patent No.: US 7,621,526 B2
(45) Date of Patent: Nov. 24, 2009

(54) APPARATUS FOR STACKING INDIVIDUAL SHEETS

(75) Inventors: Hans Blaser, Burgdorf (CH); Armin Zobeli, Sigriswil (CH)

(73) Assignee: BEB Industrie-Elektronik AG, Oberburg (CH)

( * ) Notice: Subject to any disclaimer, the term of this patent is extended or adjusted under 35 U.S.C. 154(b) by 0 days.

(21) Appl. No.: 12/281,866

(22) PCT Filed: Mar. 9, 2007

(86) PCT No.: PCT/EP2007/002082

§ 371 (c)(1),
(2), (4) Date: Sep. 5, 2008

(87) PCT Pub. No.: WO2007/101704

PCT Pub. Date: Sep. 13, 2007

(65) Prior Publication Data

US 2009/0066004 A1 Mar. 12, 2009

(30) Foreign Application Priority Data

Mar. 9, 2006 (DE) ..... 10 2006 011 389

(51) Int. Cl.
*B65H 29/40* (2006.01)
*B65H 31/04* (2006.01)

(52) U.S. Cl. ..... 271/178; 271/215

(58) Field of Classification Search ..... 271/177, 271/178, 207, 213, 215, 163
See application file for complete search history.

(56) References Cited

U.S. PATENT DOCUMENTS 4,067,568 A * 1/1978 Irvine ..... 271/176
4,500,245 A * 2/1985 Madewell et al. ..... 414/798.7
4,657,237 A * 4/1987 Hansch ..... 271/178

FOREIGN PATENT DOCUMENTS

DE 101 01 563 A1 8/2002

* cited by examiner

*Primary Examiner*—David H Bollinger
(74) *Attorney, Agent, or Firm*—Rankin, Hill & Clark LLP

(57) ABSTRACT

The invention relates to an individual-sheet stacking apparatus including a frame, a support which is displaceably guided at the frame and which is fitted with a rest surface for the individual sheet stack and having a pressurizing spindle to alternatingly shift and release the support. The pressurizing spindle consists of a pressurizing shaft rotatably supported at the frame, two pressurizing spindle lateral elements affixed to the pressurizing shaft, and at least two glide shafts configured in a fixed or rotatable manner at the pressurizing spindle lateral elements, the glide shafts being fitted with glide rollers. A drive means drives the pressurizing spindle into rotation.

13 Claims, 5 Drawing Sheets

APPARATUS FOR STACKING INDIVIDUAL SHEETS

BACKGROUND OF THE INVENTION

The present invention is based on an apparatus stacking sheets, in particular money bills.

The state of the art of the German patent document 101 01 563 A1 discloses an apparatus delivering and accepting individual sheets. The singularization and stacking of the individual sheets is implemented by the cooperation of a stack support fitted with a drive, two transport rollers and a sector cylinder with several sector rollers. In order to feed an individual sheet to a stack resting on said support, this individual sheet is pulled in by the two transport rollers and inserted along a guide surface into a slit between the sector cylinder and the end stack surface. To secure enough space for the individual sheet between the sector cylinder and the stack end surface, the drive pulls back said support. Next, the individual sheet is moved toward the stack. This design incurs the drawback that not only the transport rollers and the segment drum must be driven, but also the support. In other words, a first drive must be provided for the rollers and cylinder and a second one for the support. Moreover, the drive requires a control fitted with a commensurate sensor system. As a result, not only is apparatus manufacture costly, but energy also must be applied to both drives to operate the apparatus, entailing further costs.

The objective of the present invention is to create an individual sheet stacking apparatus of lower costs of manufacture and operation than are incurred in the apparatus of the state of the art.

BRIEF SUMMARY OF THE INVENTION

Compared to the state of the art, the apparatus of the present invention includes on one hand a displaceably guided support with a rest surface for a stack of individual sheets and on the other hand a pressurizing spindle to alternatingly shift and release the support. In a first position, the support is situated directly against the pressurizing spindle before any sheet lies on the support. When inserting individual sheets into a stack at the support, the same is displaced by the pressurizing spindle at every individual sheet by exactly that distance which corresponds to the individual sheet's thickness. This shifting motion is implemented solely by the pressurizing spindle. A further drive is not needed. The support is displaced until the stack is full. The support will be in its second position at the end of stacking. In this second position, the spacing between the support and the pressurizing spindle does correspond to the stack's thickness. After removing the stack, the support is returned into its first position directly against the pressurizing spindle. This motion may be manual or automated.

The pressurizing spindle, alternatingly displacing and releasing the support, consists of a pressurizing shaft rotatably supported on the lateral parts of a frame of the apparatus, of two pressurizing spindle lateral elements affixed to the pressurizing shaft and at least two glide shafts with glide rollers mounted on pressurizing spindle lateral parts at equal radial distances and parallel to the pressurizing shaft. The glide rollers may be configured rotatably or in fixed manner on the pressurizing spindle lateral parts. The glide rollers in turn may be configured rotatably or in a fixed manner on the glide shafts. Advantageously, the glide rollers are mounted rotatably on the fixed glide shafts. At least either the glide shafts or the glide rollers should be rotatable to preclude that, when the glide rollers roll off the uppermost individual sheet of the stack, this sheet should be shifted. The positions of the individual stack sheets should remain unchanged when an additional individual sheet is added. The pressurizing spindle is merely used to displace the support to make room for the individual sheets to be admitted into the stack. The individual sheets are not moved by the pressurizing spindle. To make sure, the surfaces of the glide rollers should be as smooth as possible. This condition minimizes the friction between the glide rollers and the individual sheets. Advantageously, a limiting element is configured above the pressurizing spindle to avert shifting the individual sheets upwards.

In an especially preferred manner, three or four glide shafts with glide rollers are mounted on the pressurizing spindle lateral parts. By selecting this number of glide shafts, the gap is large between the glide shafts with their associated glide rollers available for an individual sheet, on one hand, and on the other, the sequence of alternating displacements and releases will optimally match the feeding of the individual sheets.

The guide assures that the support shall be consecutively displaced with each inserted individual sheet and that the displacement is rectilinear. Because of the inertia of the system constituted by the support and the guide, the support shall be displaced each time only as far as it is moved through the pressurizing spindle. Displacement over a larger distance or in the opposite direction is precluded short of applying an external, additional force. In this manner, the support shall advance each time only by the length corresponding to the thickness of one sheet.

Thanks to the cooperation between the support and the pressurizing spindle, only one drive is needed for said spindle. The support being displaced by the pressurizing spindle, a support drive to stack the individual sheets is superfluous. Additional control means and associated sensors can be dispensed with.

One advantageous design of the present invention includes a transport roll to seize a sheet being fed to it in the direction of motion of the individual sheet in front of the pressurizing spindle. The transport roll includes a transport shaft rotatably resting on the lateral frame parts parallel to the pressurizing shaft. Several mutually apart disks that are coaxial with the pressurizing shaft are mounted on the transport shaft. The transport shaft cooperates with one or more guides. These guides are straight or curved plates affixed to the frame. They are mounted in such a manner on the frame that when an individual sheet is being moved, at least one plate shall be positioned above and at least one plate underneath said individual sheet. Advantageously the apparatus of the present invention may be additionally fitted with a guide spindle which also cooperates with the transport roll. The guide spindle consists of a shaft and several transport disks configured coaxially with and on the shaft. The plates are configured mutually spaced apart as a result of which the guide spindle may act by means of the transport disks between the plates in order to move an individual sheet. The individual sheet is frictionally displaced between the individual sheet and the transport disks. The transport disks of the transport shaft preferably are connected rigidly to the transport shaft. The surface of the displacing disks is rough to prevent the individual sheet from slipping along the displacing disks. In one advantageous embodiment mode of the present invention, the transport spindle is driven via a gear by the same drive acting on the pressurizing spindle.

In another further embodiment of the present invention, one or more individual sheet guides are configured underneath the pressurizing spindle in front of the support. The individual sheet guides assure that an individual sheet's edge pointing forward in the direction of advance shall be moved—after having been released from the transport roll or from another conveying element—to that zone wherein the pressurizing spindle touches the support or the stack resting against the support. The single sheet guide may run as an integral part over the full length of the pressurizing spindle or be configured in the form of strip-like, individual single sheet guides between the transport disks or the glide rollers of the pressurizing spindle. Preferably, the individual sheet guides are leaf springs. Advantageously too, the individual sheet guides shall rise at least to a height corresponding to that of the pressurizing shaft. In an especially preferred manner, the individual sheet guide length seen in the direction of advance corresponds to that of the individual sheets in the direction of advance. As a result, an individual sheet shall be reliably guided even when there are creases in it before it is inserted into the conveying system.

A further advantageous embodiment of the present invention comprises a brush roll to pressurize the edges of the individual sheets configured in the stack. This feature precludes protrusion of the stack's individual sheet edges facing an individual sheet being inserted. Again, as a result, the approaching individual sheet shall always be inserted at the front on the stack, not behind the uppermost or another individual stack sheet. Also, the brush roll forces the edge pointing to the rear as seen in the direction of advance of the individual sheet to be inserted against the stack when said edge is released by the transport roll or another transport element. The brush roller is fitted with a bristle shaft supported at the lateral frame parts parallel to the pressurizing shaft. A plurality of bristle bundles pointing radially outward are affixed to the brush shaft. Advantageously, the brush roll is driven by means of a gear unit by the same drive as is the pressurizing spindle and where called for the transport roll. The bristles may be replaced by impellers mounted on a driven shaft. The impellers project radially outward. The resiliency of the particular impellers is implemented by using, for instance, materials such as thermoplastic elastomers. The impellers improve the transport in the direction of advance of a single sheet's rear edge.

In another advantageous embodiment of the present invention, the guide system comprises a beam firmly affixed to the support. The beam is guided at the two lateral parts of the frame. For that purpose the lateral parts are fitted with elongated holes or elongated slits engaged by the beam's ends. In such a design the weight of the support and beam bears on the lateral parts. The support advantageously is mounted rigidly to the beam at an angle to the vertical and at a slant.

In another embodiment mode of the present invention, the support guide comprises at least one belt and two pulleys for each belt. The support is firmly connected to the belt(s). An additional affixation means may be provided. Illustratively, the belts also may be affixed to the beam. The belt(s) running around the pulleys move in respectively opposite the direction of motion. They act as stop surfaces to the lower edges of the individual stack sheets. Advantageously, the belt surface facing the stack and the support shall be roughened.

In a further advantageous embodiment mode of the present invention, the belts are toothed belts and the pulleys are toothed belt pulleys. Because of the geometric interlocking of the belts and the toothed pulley(s), the belt(s) cannot slip relative to the pulleys. As a result, the pressurizing spindle always must drive the belts and the associated toothed pulleys to displace the support.

In a further advantageous implementation of the present invention, the belt(s) is/are guided by the pulleys in part above and in part below the base. That part above the base rests against it. In this manner this portion of the belt(s) together with the support and an optionally additional fastener can rest on the base.

In a further advantageous embodiment of the present invention, one of the belt pulleys is fitted with a belt drive to allow—following removing a stack out of the apparatus—moving the support out of its second position back into its first position at the pressurizing spindle. Preferably, the drive is fitted with a propulsion spring or a spiral spring. The spring forces the support against the pressurizing spindle. The support is fitted directly or indirectly with a stop-advance element. Merely by unlocking it, the support may be moved from its end position—which corresponds to a full stack—back into its initial position near the pressurizing spindle.

Further advantages and advantageous designs of the present invention are defined in the description below, the appended drawings and the claims.

BRIEF DESCRIPTION OF THE DRAWINGS

The appended drawing shows an illustrative embodiment mode of the present invention.

DETAILED DESCRIPTION OF THE INVENTION

Figure 1:
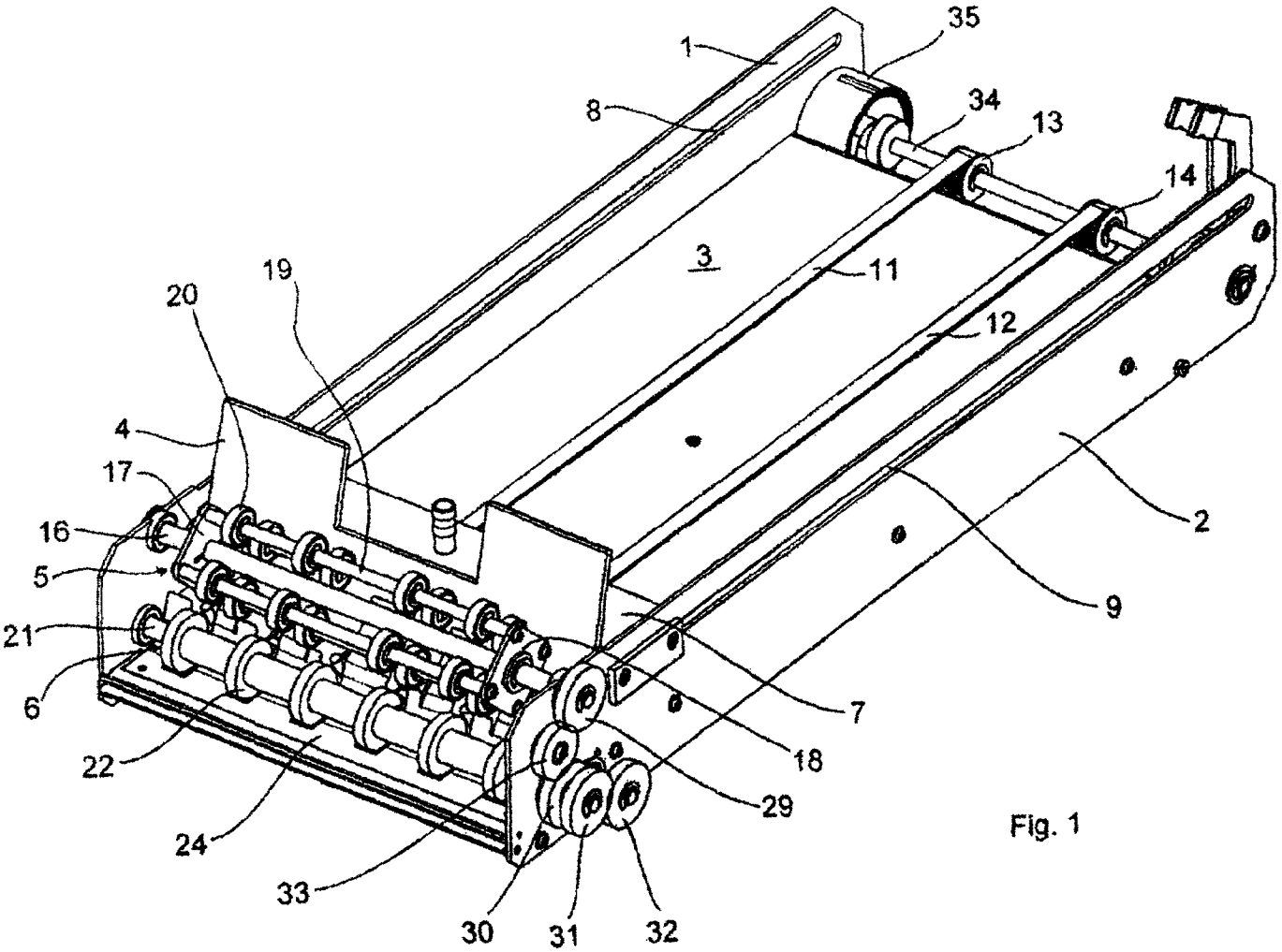
FIG. 1 shows a front perspective of an apparatus stacking individual sheets (housing omitted)
Figure 2:
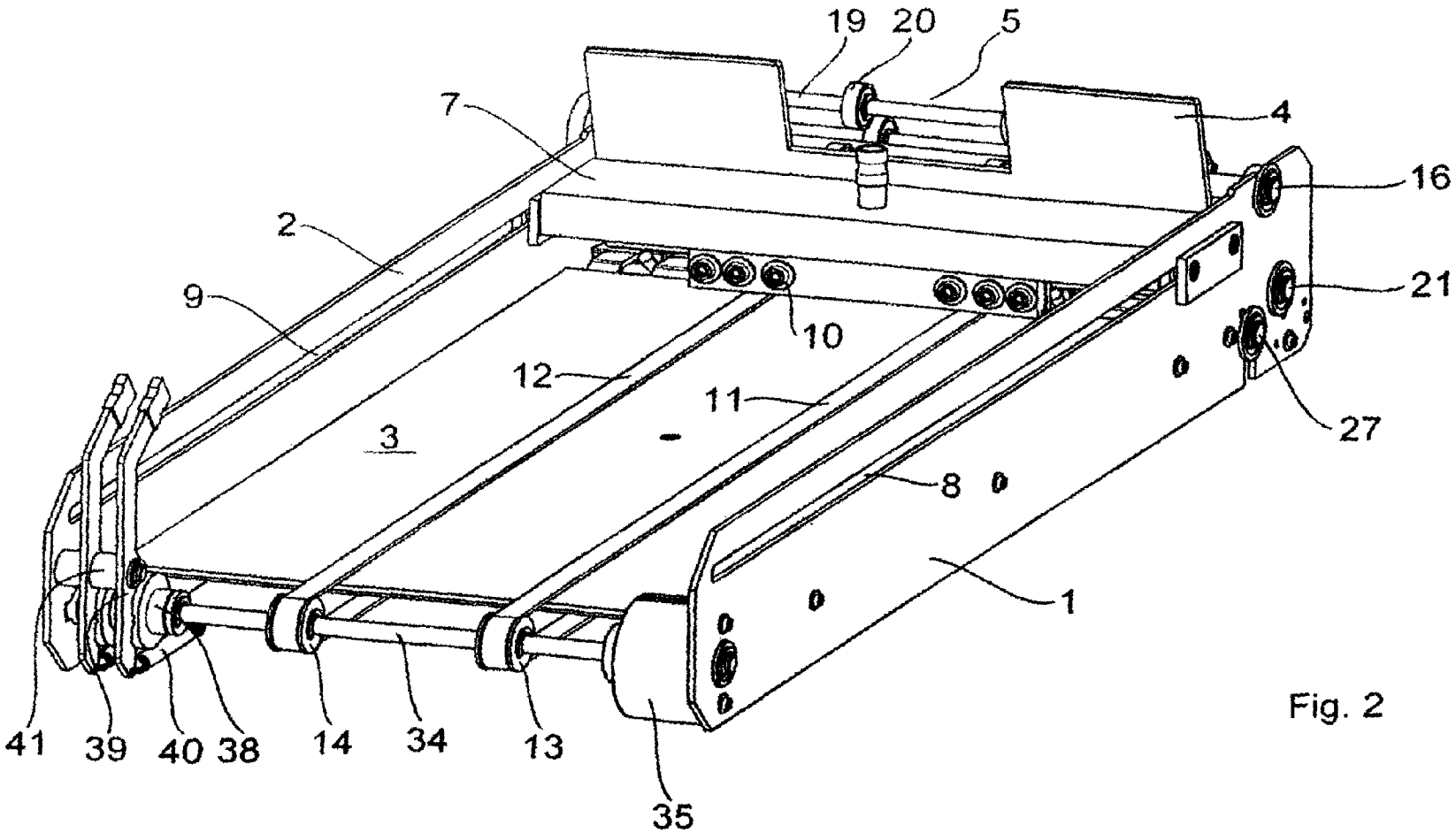
FIG. 2 is a rear perspective view of the apparatus of FIG. 1.
Figure 3:
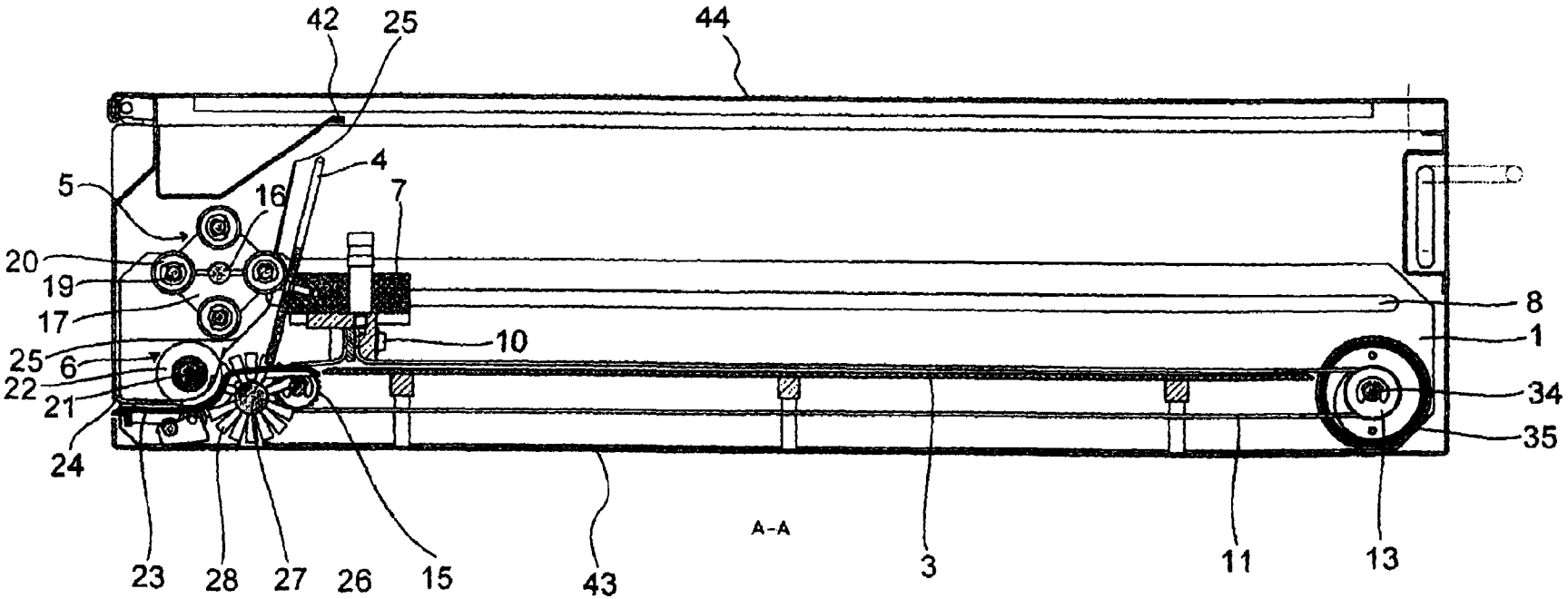
FIG. 3 is a cross-section of the apparatus of FIG. 1 along the plane denoted A-A in FIG. 4.
Figure 4:
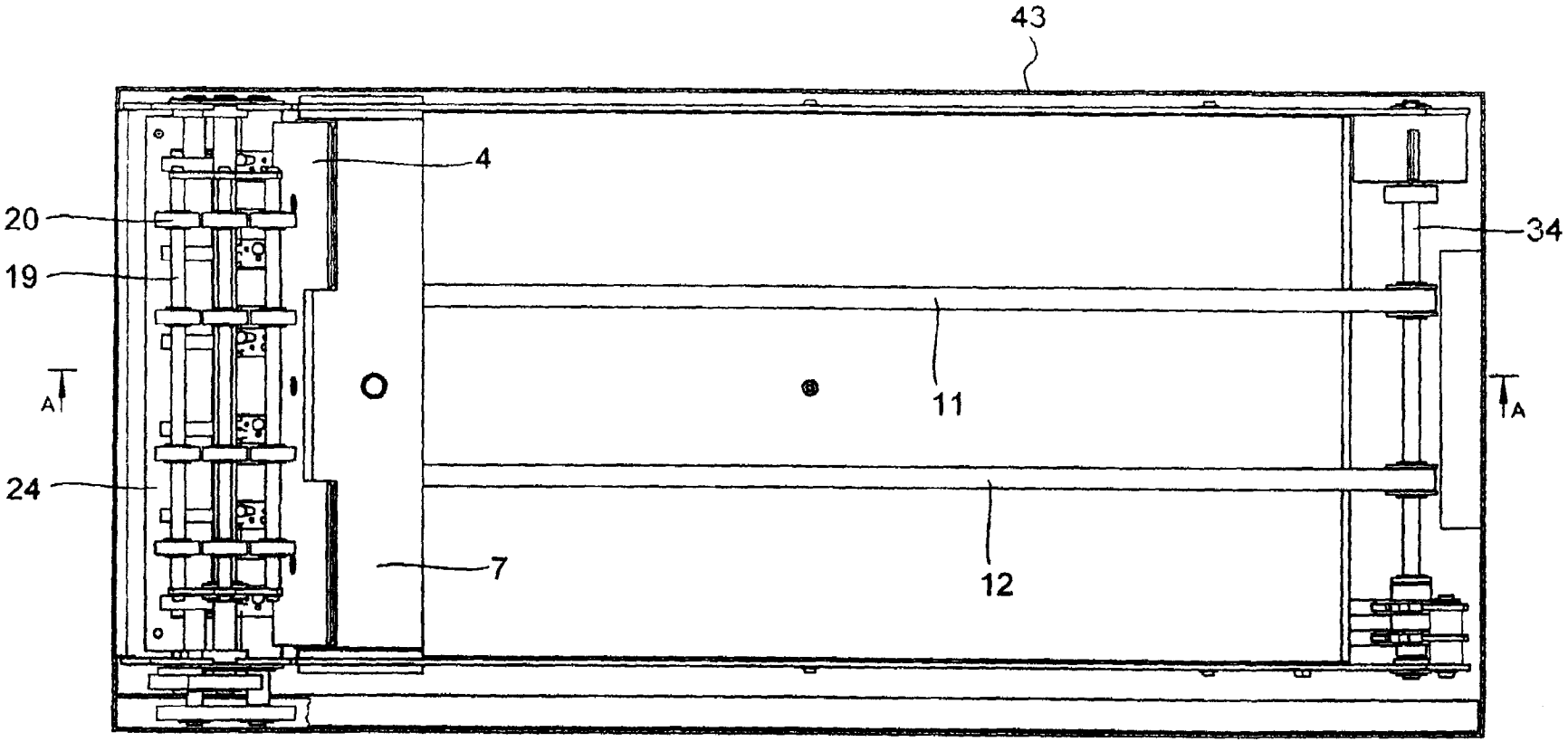
FIG. 4 is a topview of the apparatus of FIG. 1.

FIGS. 1 through 5 show individual sheet stacking apparatus comprising two lateral parts 1 and 2, a base 3, a support 4, a pressurizing spindle 5 and a transport roll 6. The support 4 substantially consists of a rectangular plate with a central cutout affixed to a beam 7 while oblique to the vertical. The beam 7 is guided in two long slits 8 and 9 of the lateral parts 1 and 2. Two toothed belts 11 and 12 are affixed to the beam by screws 10. The teeth of the toothed belts cannot be seen in the drawing. The toothed belts run on toothed pulleys 13, 14, and 15. The two rear toothed pulleys 13 and 14 are shown in FIGS. 1, 2 and 4. FIG. 3 additionally shows one of the two toothed pulleys 15. The second front toothed pulley is absent from all Figures.

The pressurizing spindle 5 comprises a pressurizing shaft 16 rotatably supported in the two lateral parts 1 and 2. Two pressurizing spindle side elements 17 and 18 are affixed to the pressurizing shaft 16. Said side elements are cross-sectionally square. A glide shaft 19 is affixed at each end of the pressurizing spindle lateral parts, so that a total of four glide shafts 19 are configured at the pressurizing spindle. Each glide shaft is fitted with a total of four glide rollers 20. The glide rollers 20 are rotatably connected to the glide shafts 19.

Figure 5:
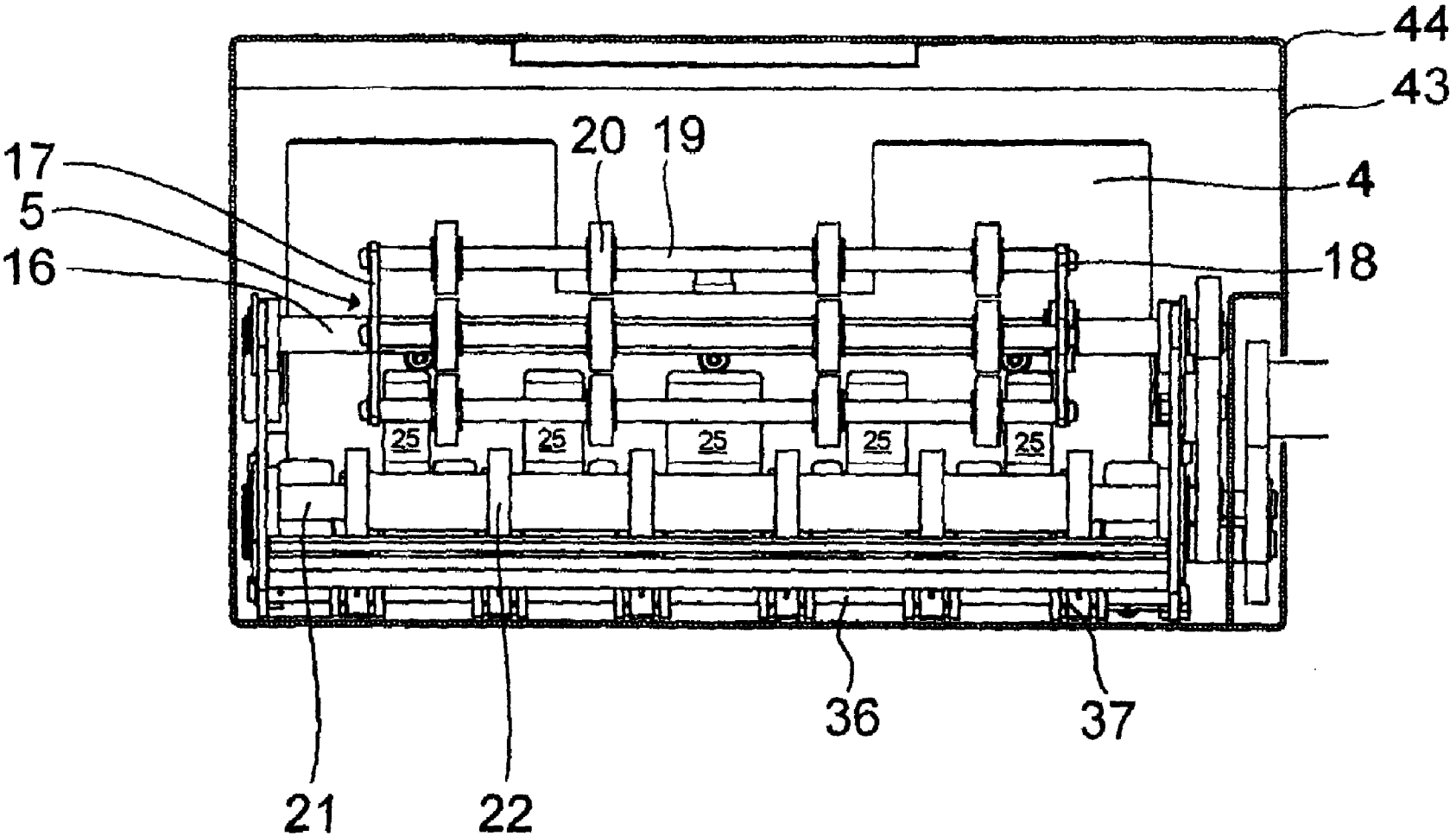
FIG. 5 is a front elevation of the apparatus of FIG. 1.

A transport roll 6 is configured underneath the pressurizing spindle 5. Said conveying spindle comprises a transport shaft 21 rotatably supported on the two lateral parts 1 and 2. A total of six transport disks 22 are affixed to the transport shaft 21. The transport disks 22 are rigidly connected to the transport shaft 21. Several individual sheet guides are configured in the region of the pressurizing spindle 5 and the transport roll 6. A first individual sheet guide 23 runs in the advance direction from the front end of the two lateral parts 1 and 2 as far as the region of the front toothed pulleys 15. This feature is shown especially clearly in FIG. 3. The first individual sheet guide 23 runs perpendicularly to the direction of advance, further over the full width of the frame between the two lateral parts 1 and 2. The first individual sheet guide 23 follows, at least partly, the shape of the transport disks 22, as a result of which only a small guidance gap remains between said transport disks and the first individual sheet guide. In the region ahead of the transport roll 6, the first individual sheet guide 23 is covered above by a second individual sheet guide 24. A gap is subtended between the first and the second individual guide somewhat larger than the thickness of an individual sheet. In this manner an approaching individual sheet arrives as far as the transport spindle without encountering excessive friction that would be entailed by a too narrow gap. As seen in the direction of advance, as soon as the individual sheet, by its front edge, reaches the region of the transport roll 6, it will be forced by the transport disks 37 of a guide spindle 36 against the transport disks 22. The guide spindle 36 and the transport disks 37 of the guide spindle 36 are shown in FIG. 5. Because of the friction entailed between the transport disks 22 and 37 on account of their rough surfaces on one hand and the individual sheet on the other, said individual sheet is gripped and transported. The force required for significant friction is generated by the transport disks 37 of the guide spindle 36. Third individual guides 25 are configured above the transport roll 6. Said guides run as seen in the direction of advance from the transport disks 22 of the transport roll 6 as far as into the region above the glide rollers 20 of the pressurizing spindle 5 near the support 4. This path is shown in FIG. 3. FIG. 5 shows the position of the third individual sheet guides 25 perpendicular to the direction of advance. These third individual sheet guides 25 extend width-wise in the gaps between the transport disks 22 and the glide rollers 20.

A limiting element 42 is configured above the pressurizing spindle and prevents the individual sheets from being pushed upward. Said element moreover is covered upward as a whole by a cover 44. It limits the upward stack height. The cover is affixed by a hinge and a lock to a housing 43 enclosing the apparatus. Both hinge and lock are omitted from the drawing.

A brush roll 26 is configured underneath the support 4 and behind the transport roll 6. This configuration is shown in FIG. 3. The brush roll comprises a brush shaft 27 rotatably supported in the two lateral side parts 1 and 2. Numerous bundled bristles 28 are configured on the brush shaft and distributed over its entire length and entire circumference.

The pressurizing spindle 16, the transport shaft 21 and the brush shaft 27 are fitted at their ends projecting beyond the lateral part 2 with gears 29, 30, 31 and 32. Another gear 33 rotatably configured at the lateral part 2 transmits the rotation of the gear 29 to the gear 30. The gear 31 engages the gear 32. The gears 29 through 33 constitute a gear unit. To drive into rotation the pressurizing spindle, the transport roll and the brush roll, no more need be done than to connect one of the gears or the associated shaft to a drive. The drive is not shown in the drawing.

The two rear toothed belt pulleys 13 and 14 are mounted on a common toothed pulley shaft 34 rotatably supported in the two lateral parts 1 and 2. A propulsion spring is configured at the toothed belt shaft 34 in the region of the lateral part 1. A spiral spring may also be used instead of a propulsion spring. Such a drive is used to force the support 4 against the pressurizing spindle. A stop-advance element 38 shown in FIG. 2 and configured at the toothed pulley shaft 34 assures the support 4 shall be pushed stepwise by the pressurizing spindle from an initial position near the pressurizing spindle into a final position near the toothed pulley shaft. This stop-advance element precludes the possibility of a displacement in the opposite direction while receiving the individual sheets into a stack. The stop-advance element 38 is connected by a serration not visible in the drawing with a lever 39. This lever is forced by a tension spring 40 against the serration of the stop-advance element 38. Said lever rests by means of the shaft 41 against the housing. When the lever 39 is pivoted out of its initial position shown in FIG. 2, into a second position and in the process is rotated about the shaft 41, the serration of the stop-advance means will be disengaged. The propulsion spring assures that the support 4 is returned from its rearmost position—especially following removal of a complete stack of individual sheets not shown in the drawing—back into its initial position near the pressurizing spindle 5. This initial position of the support 4 is shown in FIGS. 1 through 5.

The individual sheets are stacked as follows:

In the beginning the support 4 is in its initial position or first position directly at the pressurizing spindle 5. Therein the glide rollers 20 of one of the glide spindles 19 do touch the support 4 at its surface. No individual sheets yet are situated at the support. Next, an individual sheet is fed in-between the first and second individual guides 23 and 24. As soon as the individual sheet (omitted from the drawing) is situated between the transport disks 22 of the transport roll 6 and the transport disks 37 of the guide spindle 36, it shall be moved upward by the transport roll 6. For that purpose and as shown in FIG. 3, the transport roll 6 is rotated counter-clockwise. As soon as the front edge—as seen in the direction of advance—of the individual sheet has been released by the transport spindle, it arrives in the region of the third individual sheet guides 25. Part of the individual sheet still remaining between the transport disks 22 of the transport roll 6 and the transport disks 37 of the guide spindle 36, said individual sheet will further be pushed upward. The third individual sheet guides 25 assure that said sheet's front edge reaches the region wherein the glide rollers 20 touch the support 4. The distance subtended in the circumferential direction of the pressurizing spindle between the glide rollers of different glide shafts and the ensuing gap between the support 4 and the glide rollers 20 allows placing the individual sheet's front edge against the support. Moreover the transport spindle assures that the individual sheet shall be pushed upward. The third individual sheet guides 25 above the pressurizing spindle 5 ensure that an individual sheet shall remain duly near the stack. This is especially the case regarding crumpled individual sheets because of their own stresses. As soon as the individual sheet front edge rests against the support, the glide rollers 20 of a further glide shaft 19 and because of the pressurizing spindle rotation touch the guided individual sheet and ensure that the support shall be exactly moved back by the distance corresponding to the individual sheet's thickness. The guide rollers, being rotatable relative to the glide shafts, and moreover having a smooth surface, said individual sheet shall not be moved, or only negligibly so, by the glide rollers. To preclude that on account of excessive friction an individual sheet being deposited on the front stack edge be pushed upward excessively, the limiting element 42 is configured above the pressurizing spindle 5. The pressurizing spindle is rotated counter-clockwise. After the rear edge of an individual sheet has passed the guide spindle 36, further transportation is implemented by the pressures from the bristles 28 of the brush roll 26 on the individual sheet and hence on the transport roll 6. As soon as the rear edge—as seen in the direction of advance—of the individual sheet has been released by the transport roll 6 and the first individual sheet guide 23, the lower region of said sheet is seized by the bundles of bristles 28 of the brush roll 26 and forced against the support 4. In the process said individual sheet orients itself in a manner that it shall rest by its full surface on the support 4. The next individual sheet is fed in the same manner. This procedure is repeated until either the stack does contain the desired number of individual sheets or the support 4 is in its rearmost position near the toothed pulley shaft 34. After the stack has been removed, the lever 39 is pivoted and released from the serration of the stop-advance element 38. Next, the propulsion spring 35 causes the support 4 jointly with the beam 7 to be returned into its initial position at the pressurizing spindle 5. Optionally, the support also may be manually returned into its initial position at the pressurizing spindle 5. Stacking may then begin again.

As soon as several individual sheets have been received in a stack, the support 4 is situated a distance from the pressurizing spindle 5 corresponding to the stack thickness. In that position the stack's individual sheets rest by their lower edges on the two toothed belts 11 and 12. The support 4 being firmly connected by the beam 7 and the screws 10 to the two toothed belts 11 and 12, the individual sheets standing on the toothed belts are entrained by them when the support 4 is shifted. As a consequence when the stack is displaced jointly with the support 4 and the belts, no friction arises between the stack's individual sheets and a substrate. The force by which the pressurizing spindle 5 must shift the support 4 and the stack ever larger and heavier with each new sheet therefore changes only slightly.

All features of the present invention may be construed being inventive per se or in arbitrary combinations.

LIST OF REFERENCES

1 lateral part
2. lateral part
3 base
4 support
5 pressurizing spindle
6 transport roll
7 beam
8 slit in lateral part 1
9 slit in lateral part 2
10 screw
11 toothed belt
12 toothed belt
13 toothed belt pulley
14 toothed belt pulley
15 toothed belt pulley
16 pressurizing shaft
17 pressurizing spindle side element
18 pressurizing spindle side element
19 glide shaft
20 glide roller
21 transport shaft
22 transport disk
23 first individual sheet guide
24 second individual sheet guide
25 third individual sheet guide
26 brush roll
27 brush roll
28. bristles
29 gear
30 gear
31 gear
32 gear
33 gear
34 toothed belt pulley shaft
35 propulsion spring
36 guide spindle
37 guide spindle transport disk
38 stop-advance element
39 lever
40 tension spring
41 shaft
42 limiting element
43 housing
44 cover

The invention claimed is:

1. An individual-sheet stacking apparatus comprising:
a frame fitted with two mutually opposite lateral parts,
a base between the lateral parts,
a support displaceably guided between the lateral parts and having a rest surface for an individual sheet stack on the side of its initially received first individual sheet,
a guidance system for the support to displace it between a first position at the beginning of stacking at which no individual sheet as yet is present at the support and a second position at the end of a stacking procedure when the stack is full,
a pressurizing spindle to alternatingly displace and release the support in order to insert an applied individual sheet into the gap subtended between the pressurizing spindle and the stack resting against the support and to place said sheet from the front onto the stack,
a pressurizing shaft—of the pressurizing spindle—rotatably supported at the two lateral parts,
two pressurizing spindle lateral elements fixed to the pressurizing shaft,
at least two glide shafts mounted in rotatable or fixed manner to the pressurizing spindle lateral elements,
the at least two glide shafts configured at equal radial distances from and parallel to the pressurizing shaft, said glide shafts being fitted with several glide rollers mounted in rotatable or fixed manner to said glide shafts, and
a drive for the pressurizing spindle.

2. The apparatus as claimed in claim 1, wherein the apparatus includes a transport spindle to grip an applied individual sheet, in that said transport spindle is fitted with a transport shaft rotatably supported at the frame lateral parts parallel to the pressurizing shaft and in that several transport disks are configured on the transport shaft while being mutually apart and coaxial with said transport shaft.

3. The apparatus as claimed in claim 2, wherein a gear unit is configured at the transport roll and/or the pressurizing spindle and drives the transport roll and the pressurizing spindle using a common drive means.

4. The apparatus as claimed in claim 1, wherein one or more individual sheet guides are configured underneath the pressurizing spindle in front of the support.

5. The apparatus as claimed in claim 1, further comprising a brush roll to compress the edges of the individual sheets of the stack, in that the brush roll is fitted with a brush shaft rotatably supported in the lateral frame parts and parallel to the pressurizing shaft and in that bristles are affixed to the brush shaft.

6. The apparatus as claimed in claim 5, wherein a gear unit is configured at the brush roll and/or the pressurizing spindle and drives the brush roll and the pressurizing spindle using a common drive means.

7. The apparatus in claim 1, wherein the guide for the support comprises a beam, and the support is affixed to the beam, and a guide for the beam is configured at both lateral parts of the frame.

8. The apparatus as claimed in claim 1, wherein the guide for the support comprises at least one belt and two belt pulleys for each belt and that the support is firmly affixed to the belt(s).

9. The apparatus as claimed in claim 8, wherein the belt(s) constitute(s) at least in a segment a stop surface for the lower edge of the individual sheets in the stack.

10. The apparatus as claimed in claim 8, wherein the belts are roughened at their surface away from the belt pulleys.

11. The apparatus as claimed in claim 8, wherein the belts are toothed belts and the belt pulleys are toothed belt pulleys.

12. The apparatus as claimed in claim 8, wherein the belt is guided through belt pulleys above and below the base and that the part above the base rests on it.

13. The apparatus as claimed in claim 8, wherein a belt drive is mounted on one of the belt pulleys so that, after removing a stack from the apparatus, the support may be moved out of its second position back into its first position at the pressurizing spindle.

* * * * *